United States Patent [19]

Van Ryn et al.

[11] 4,063,392

[45] Dec. 20, 1977

[54] TELESCOPING SEATING SYSTEM WITH AUTOMATICALLY FOLDING CHAIRS

[75] Inventors: Arthur Louis Van Ryn; William Rudolph Van Loo, both of Grand Rapids, Mich.; David William Raymond, Champaign, Ill.

[73] Assignee: American Seating Company, Grand Rapids, Mich.

[21] Appl. No.: 767,755

[22] Filed: Feb. 11, 1977

[51] Int. Cl.[2] ..... E04H 3/12

[52] U.S. Cl. ..... 52/9; 297/236

[58] Field of Search ..... 52/8–10, 52/183; 297/232, 234–239, 248

[56] References Cited

U.S. PATENT DOCUMENTS

| | | | |
|---|---|---|---|
| 2,817,122 | 12/1957 | Walworth | 52/9 |
| 2,968,843 | 1/1961 | Fording | 52/10 |
| 2,987,111 | 6/1961 | Walworth | 52/9 |
| 3,025,106 | 3/1962 | Evans et al. | 52/9 X |
| 3,352,069 | 11/1967 | Curra | 52/9 |
| 3,977,722 | 8/1976 | Gist | 297/143 |

*Primary Examiner*—J. Karl Bell

*Attorney, Agent, or Firm*—Emrich, Root, O'Keeffe & Lee

[57] ABSTRACT

A seating system having a number of rows which may be extended for use or retracted for storage is provided with individual chairs. As each row is moved forwardly relative to the next higher row, the chair backs pivot to the upright or use position where they are latched. As each row is moved rearwardly relative to the next higher row, the latches holding the chair backs in the use position are released and the chair backs are engaged by the deck of the next higher row to fold the chair backs downwardly and forwardly to the closed or storage position so that they may be stored in the space between adjacent decks.

12 Claims, 13 Drawing Figures

10D
10C
10B
10A
19A
19
4A
4B

TELESCOPING SEATING SYSTEM WITH AUTOMATICALLY FOLDING CHAIRS

BACKGROUND AND SUMMARY

The present invention relates to telescopic seating systems; and more particularly, it relates to telescopic seating systems of the type which provide chair-type seating. In this sense, the word "chair" indicates that the seating includes a seat portion and a back portion, and it is broad enough to include individual chairs, ganged chairs, or benches, as persons skilled in the art will readily appreciate that the present invention is adaptable to various types of chair seating. In other words chair seating is distinguished from bleacher seating which does not include a back portion for supporting an occupant.

In telescoping seating systems of the type with which the present invention is concerned, a number of rows are provided, and these rows are independently movable relative to each other. When the rows are extended for use, they are in tiered or stepped relation, and when they are retracted for storage, they are in superposed relation.

In telescoping seating systems of the bleacher type, there is normally enough vertical spacing between the decks of adjacent rows so that when the rows are retracted, the seating fits in the space between a lower and an upper deck. With chair seating, on the other hand, the provision of a back interferes with the closing of the rows, and, in one prior art system, the chairs are individually folded and rest on a deck so that they may be stored in the space between adjacent decks when the rows are retracted for storage. Chairs of this type are disclosed in U.S. Pat. No. 3,567,276, issued Mar. 2, 1971. Thus, in prior seating systems, although chair type seating is generally more desirable from the viewpoint of comfort and esthetics, it nevertheless has required considerable time and labor in setting up a seating system for use and in folding the chairs for storage. Further, the use of individual chairs of the type disclosed in the above-identified patent has been somewhat expensive, to the extent that individual chair seating may be prohibitively expensive in some cases.

The present invention provides chair seating in a telescopic system which does not require setting up the chairs for use or hand folding them for storage—that is, the chair backs of the present invention are folded to a storage position automatically as the rows are retracted, and they fit in the space between the decks of adjacent rows.

In a preferred form of the present invention, individual seating is provided. Each chair includes a self-rising seat which is pivotally mounted to the forward portion of a deck, and a back which is also mounted for pivotal movement between a horizontal storage position and an upright use position. The seats are spring biased to a three-quarters raised position to facilitate ingress and egress when a seat is not occupied. This type of operation is known in stadium seating, see, for example, U.S. Pat. No. 3,690,726; that is, the seats may be rotated down to the horizontal or use position by sitting on them, or an occupant may rise, to let the seat rise to the three-quarters fold position, and then step further back, raising the seat to the full upright position with the back of his legs to permit a person to pass. This type of seat is available in more conventional auditorium seating.

For storage, the back is forced down by the nose portion of the next higher row during closing. On the way down, the back engages the seat at the three-quarters fold position and both back and seat are forced to the horizontal storage position as the system closes. Thus, in the preferred form, both the seat and back may be independently pivoted.

A latching mechanism is provided for holding the chair back in the upright or use position, which the backs assume when the rows are opened for use. The backs are spring-biased to rise to the use position when the system is opened, and they are latched as soon as they reach the raised position. By latching the backs in the raised position, a person passing behind the chairs may brace himself against the back which is firmly held, without fear of stumbling. Further, by having all of the chair backs automatically assume the use position when the seating system is opened, a neat appearance is provided even before occupants are permitted access to the seating system.

An actuator mechanism is provided which is responsive to the rearward movement of each row relative to the next higher row. When this occurs, the actuator mechanism releases all of the back latches for the lower row, so that as the lower row is closed beneath the next higher row, the nose portion of the deck of the next higher row will engage the rear of the chair backs and fold them (and the seats) forwardly to the storage position.

It is considered an important advantage of the present invention that release of the back latching mechanism is responsive only to the movement between a given row and the next higher row. The reason for this is that even though under normal operation the lower rows are extended first during opening of the system and retracted first during closing, nevertheless because of the friction in a large system, the unevenness of floors or small obstructions, this sequential, ordered operation is not always achieved. Hence, if for some reason during retraction, the fifth row begins to close before the fourth row is closed, the latching mechanism for the chair backs on the deck of the fifth row will be released as it moves beneath the sixth row, and before the third row has had an opportunity to close. Thus, release of the latching mechanisms is independent of the order in which the rows are closed, and jamming of locked chair backs into a next higher row is thereby prevented.

Another feature of the present invention is that the mechanism for biasing the chair backs to the raised position and the chair seats to the three-quarters fold position is completely enclosed within housings which also serve as side supports for the chair backs and seats. This minimizes the obstructions during cleaning and sweeping of the rows, and it also reduces vandalism or accidental damage to the mechanisms.

Other features of the present invention will be apparent to persons skilled in the art from the following detailed description accompanied by the attached drawing wherein identical reference numerals will refer to like elements in the various views.

THE DRAWING

DETAILED DESCRIPTION

Figures 1, 2, 3A, 3B, 4A, 4B, 5A, 5B, 5C, 5D, 6:
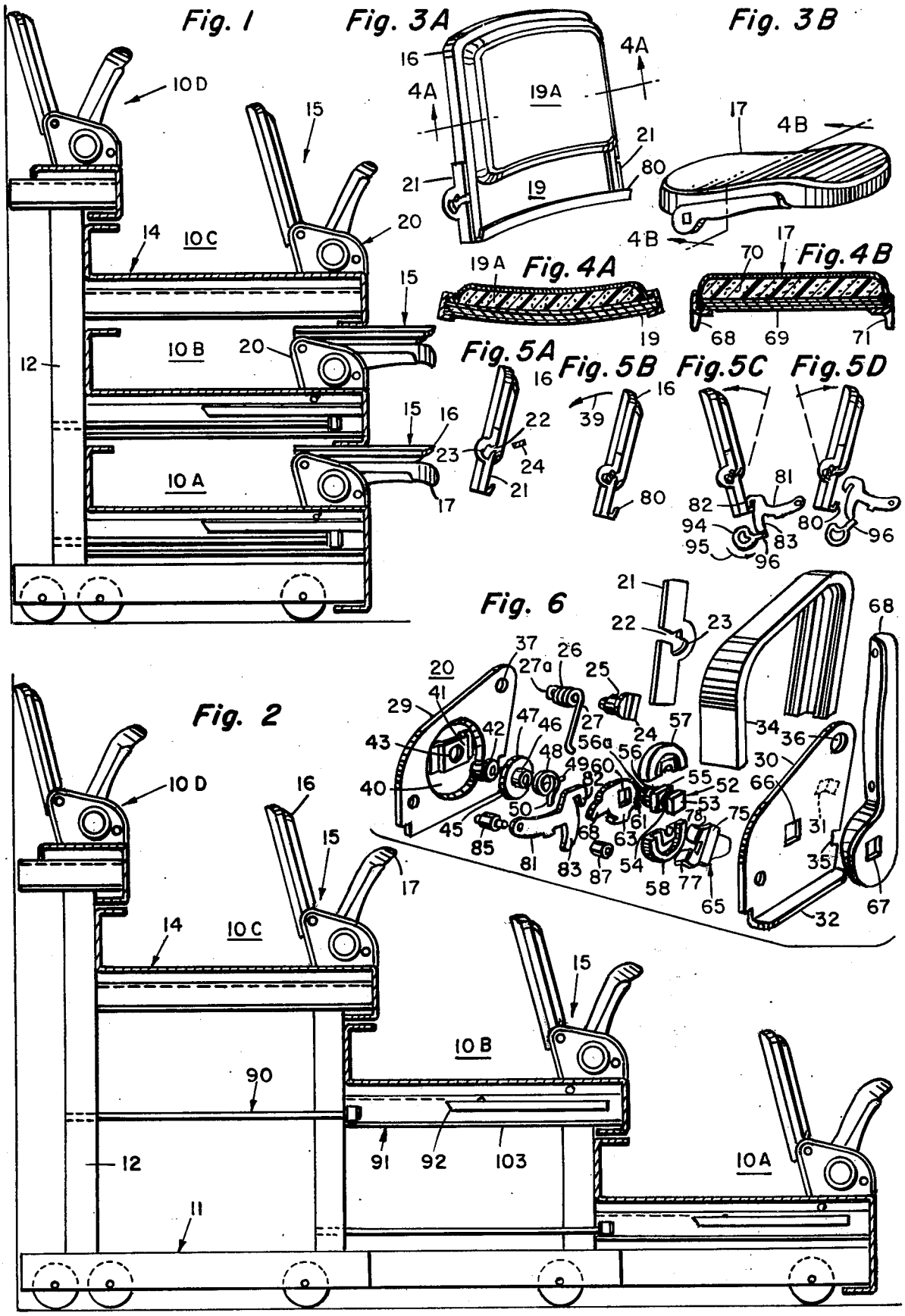
FIG. 1 is a side view of a telescoping seating system incorporating the present invention showing the lower two rows in a retracted or storage position.
FIG. 2 is a side view similar to FIG. 1 but with the lower two rows in an extended or use position.
FIGS. 3A and 3B are perspective views of a chair back and a chair seat respectively.
FIGS. 4A and 4B are cross sectional views taken through the sight lines 4A—4A and 4B—4B respectively on FIGS. 3A and 3B.
FIGS. 5A and 5B are side views of a chair back showing how it is assembled to its support.
FIGS. 5C and 5D are side views of a chair back and its associated latching mechanism with the back respectively in a locked and a released position.
FIG. 6 is an upper perspective view of the support and biasing mechanism for the chair backs, with the parts in exploded relation.

Referring now to FIGS. 1 and 2, three complete rows, and a portion of a fourth are designated respectively by reference numerals 10A–10D. In FIG. 1, the lower rows 10A and 10B in a closed or storage position in which the rows are in superposed relation; and in FIG. 2 these rows are in an open or use position in which the decks of the rows are in tiered relation. By convention, when the rows are moved from left to right in the plane of the page of FIG. 1, it is said that they are "opened" or moved forwardly. Conversely, when they are moved to the left, they are closed or moved rearwardly. Each of the rows may be similar in structure, so that only one row may be described for an understanding of the invention.

Each row includes a floor-engaging wheel channel or carriage, generally designated 11, and at least a pair of upright posts 12 which carry a deck generally designated 14. In the closed position of FIG. 1, the decks are fully cantilevered from the posts 12, and in the opened position, the forward portion of the deck are supported by the next lower row.

At the forward portion of the deck for each row, there are provided a plurality of individual chairs, generally designated by reference numeral 15. As seen in FIG. 1, when adjacent rows are moved to the storage position, the chairs are folded and stored in the space between the decks of adjacent rows. When the rows are opened, the backs of the chairs are raised under spring action and latched in an upright position, as seen in FIG. 2. Further, when the rows are opened, the seats rise to a three-quarters fold position, also seen in FIG. 2. The operation of the backs and seats will be described more fully below.

Each of the chairs 15 includes a back 16 and a seat 17. The back 16, as best seen in FIGS. 3A and 4A, includes a back panel 19 and an upholstered cushion 19A. The backs 16 and seats 17 are pivotally mounted to a pair of side supports generally designated 20. The left and right side supports 20 for each chair have similar structure and operation except that the elements of one are arranged to mirror those in the other. A left side support (when viewed from the front) is shown in FIG. 6 with the various parts in exploded relation.

A pair of metal back pivot wings 21 are attached to the sides of back panel 19. Each back pivot wing 21 includes a lead-in slot 22 which communicates with an aperture 23 in the form of an hourglass. The aperture 23 receives a keyed portion 24 of a back pivot 25. The back pivot 25 includes a cylindrical body portion which is received in the coil portion of a spring 26 which also includes an extension 27. The seat and back support 20 includes a housing comprising a pair of side plates 29, 30. The inner plate 30 is heavier, and it is flanged as at 32 for mounting to the deck 14. A housing band 34 encloses the space between the side plates 29, 30 for concealing the various elements in the seat and back support 20. The side plate 30 is notched at 35 and includes an upper aperture 36. The side plate 29 contains an aperture 37 which aligns with the aperture 36. The back pivot pin is received in the apertures 36, 37 with the pivot pin 25 extending to the right of the side plate 30. The extension 27 of the spring 26 is restrained by a clip 31 welded to the inner side of the side plate 30. A short, inwardly formed hook 27*a* on the left end of the spring 26 (FIG. 6) is received in a slot on the reduced inner portion of the back pivot 25 opposite the key 24 when the back pivot is assembled to the spring. Thus, the back pivot 25 is spring loaded. To assemble the back assembly 16, the back pivot 25 is wound clockwise from the no-torsion position of the key 24 in FIG. 5A approximately 100° to the 2 o'clock position of FIG. 5B. With the back 16 in the orientation shown in FIG. 5A and the key 24 rotated clockwise to the position of FIG. 5B, the back is positioned so that the key 24 is received through the slot 22 on the wing 21 and is seated in the shaped aperture 23, as seen in FIG. 5B. When released, the back 16 will be rotated by action of spring 26 in the direction of the arrow 39 to latch it, as will be described presently. However, it will be appreciated that the back 16 may be pivoted forwardly to a folded position, thereby further coiling the spring 26 to provide a bias for the back to the upright position when the rows are extended.

The end plate 29 is recessed at 40; and an end bearing plate 41 is mounted in the recess 40. A shoulder bushing 42 is received in an aperture 43 of the end bearing plate 41, and a spring retainer 45 provided with a cylindrical element 46 and a large flange 47 is backed up by the shoulder bushing 42. A seat spring 48 having first and second extensions 49, 50 is received in the retainer 45.

A seat pivot generally designated by reference numeral 52 includes an outer square head 53, a first reduced portion 54, an inner square head 55, a second reduced portion 56, and a third reduced portion 56*a*. A pair of split bearing plates 57, 58 hold the seat pivot 52, and they are received in the first reduced portion 54. The split bearing plates 57, 58, when assembled, are secured to the end plate 30. The inner square head 55 is received in a corresponding aperture 60 of a control plate 61. The control plate 61 includes a finger 62 and a sidewardly projecting actuator 63 which fits between the extensions 49, 50 of the spring 48. The second reduced portion 56 of the seat pivot 52 extends into the central hub 46 of the spring retainer 45. The third reduced portion 56*a* of the seat pivot 52 bears in the shoulder bushing 42.

The head 53 of the seat pivot 52 extends through a correspondingly square aperture 66 in the end plate 30 and it is received in a square aperture 67 of a seat bracket 68. Referring to FIG. 4, the seat 17 includes a bottom plate or pan 69 and a cushion 70. A pair of seat brackets 68, 71 are secured to the bottom 69.

The stop bracket 65 includes a land 75 which is engaged by the nose 62 of the control plate 61 when the seat is in its lowered use position. Extending inwardly of the land 75 and spaced above it are a pair of stops 77, 78 which extend between the extensions 49, 50 of the seat spring 48.

In operation, when the seat is lowered, the bracket 67 is rotated forwardly, thereby cranking the control plate 61 counterclockwise via the seat pivot 52. This causes the cam element 63 to engage the extension 49 of the spring 48 and rotate it counterclockwise, thereby coiling the spring. When the occupant rises, the spring 48 will urge the control plate 61 in a clockwise direction to raise the seat to its normal three-quarters raised position. From its position, as seen in FIG. 2, a person may step back and further raise the seat 17 with the back of his legs. This will cause the seat pivot 52 to crank the control plate 61 clockwise so that the cam 63 engages the extension 50 of the seat spring 48, and the extension 49 abuts the stop element 78 of the stop bracket 65. Again, it will be observed that the spring 48 is coiled so that when the occupant again steps forward, the seat will assume its normal three-quarters raised position.

Referring now to FIG. 3A, the lower portion of the seat 16 is provided with a flange 80 which serves as a catch for a back latch designated 81 in FIG. 6. The back latch 81 includes a hook element 82 which partially defines a recess adapted to engage the flange 80 at the base of the back 16 when the back is raised. Extending from the bottom of the latch 81 is an actuator or finger 83, the function of which will be described below. The latch 81 is pivotally mounted on a latch axle pin 85 having a shoulder portion spacing the latch from the end plate 29. The pin 85 also receives a second spacer 87 to position it relative to the other end plate 30 in the housing.

As indicated above, when the rows are extended for use, the back spring 26 causes the back pivot 25 to urge the back to its fully raised position, and during this motion, the flange 80 on the base of the back forces the latch 81 slightly upwardly until the hook 82 falls behind and secures the flange 80 in a locked, raised position, as illustrated in FIG. 5C.

Figure 7:
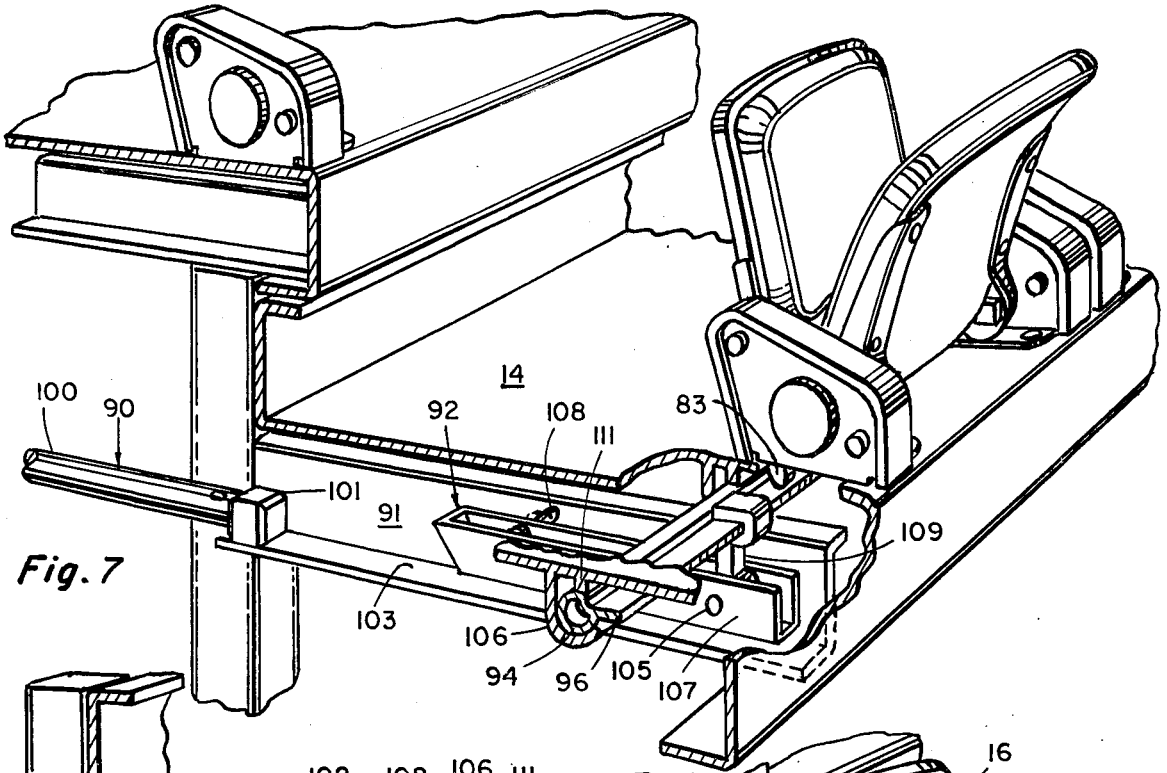
FIG. 7 is an upper perspective view of a portion of a seating system incorporating the present invention with a part of the deck broken away to illustrate the structure which actuates the latch.
Figure 8:
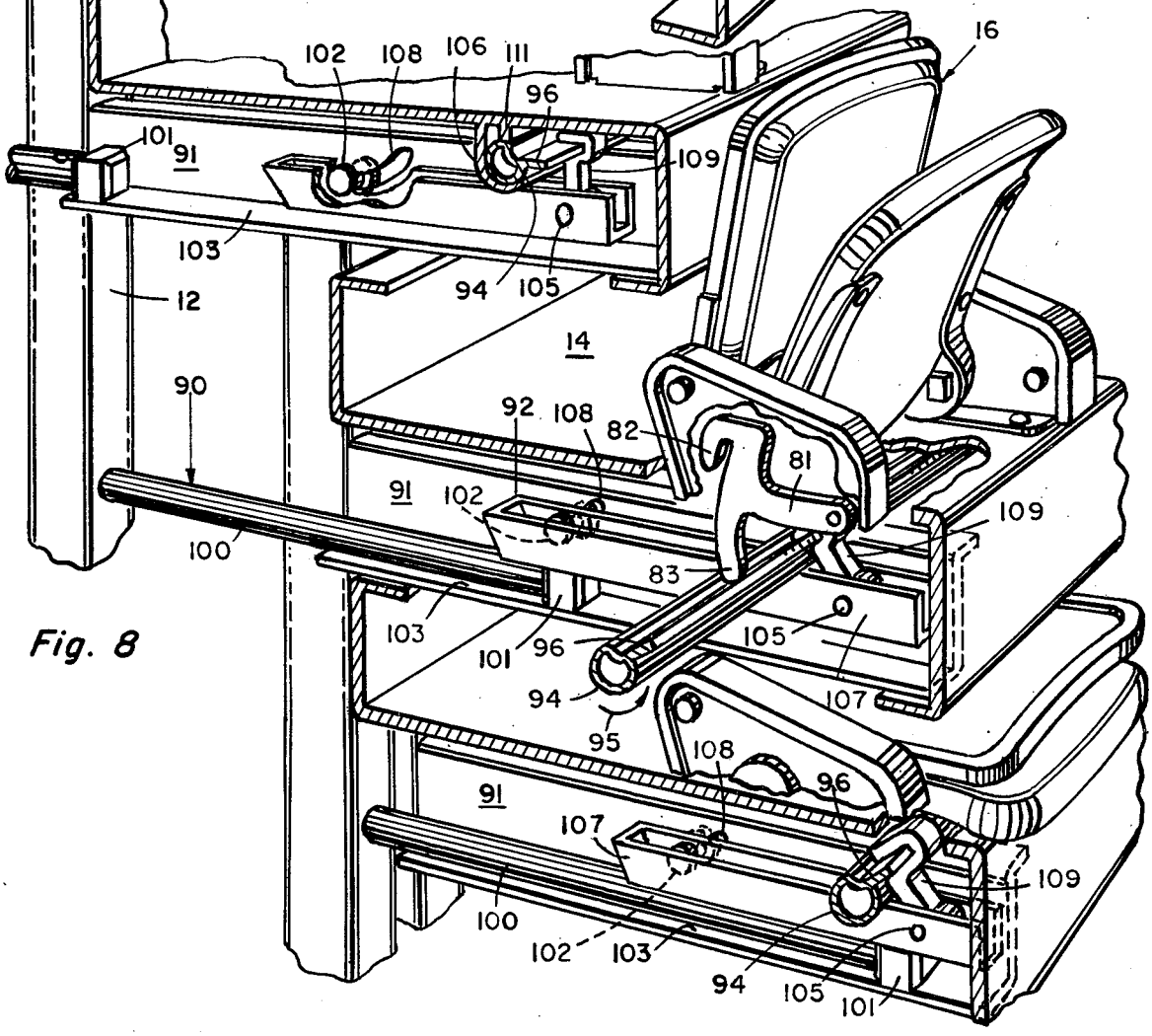
FIG. 8 is a view similar to FIG. 7 illustrating the actuation of the latching mechanism for the chair back.

In order to unlatch the back 16 when it is desired to retract the seating system, a pusher assembly generally designated by reference numeral 90 in FIGS. 7 and 8 is secured to the post 12 of the next higher row, and it extends forwardly, guided by a track 91 which is mounted beneath the deck 14 of the next lower row. A link assembly generally designated 92 is also secured beneath the deck of the next lower row and it is engageable by the pusher assembly 90 when the lower row is retracted, to turn a torque tube 94 counterclockwise in the direction of arrow 95 of FIG. 8. The tube 94 is mounted beneath the platform of the deck by J-shaped brackets 97. This rotation of the torque tube causes the upward movement of a continuous fin 96 extending radially outwardly of the torque tube 94. The fin 96 engages the lower extension 83 of the latch member 81 and rotates it upwardly to release the chair back when the torque tube is thus rotated, see FIGS. 5C, 5D and 8.

The pusher assembly 90 includes a tubular member 100 which is provided at its forward end with a plastic pusher block 101. The block 101 is adapted to slide along and be supported by a horizontal flange 103 of the track 91. The link assembly 92 includes an elongated channel-shaped link 107 to which is attached a headed slide pin 102. This pin slides in a crescent shaped slot 108 in the vertical wall of track 91. The forward end of link 107 receives a pivot pin (105) which in turn receives link 109. The upper portion of the link 109 conforms to and is rigidly secured to the continuous fin 96 on the torque tube 94 (see the lower right-hand portion of FIG. 8).

As seen best in FIGS. 1 and 2, the chair side supports 20 are secured to the deck 14 adjacent the forward or "nose" portion of the deck. This permits the seat, in the use position, to project over the rear portion of the next lower deck to provide substantial heel room for the occupant of the seat.

OPERATION

When the telescoping seating system is in the storage position, the back 16 is folded forward and extends above the seat 17 as indicated in FIG. 1, so that both portions of the chair are stored in the space between adjacent decks. When the system is extended for use, as the deck of the lower row moves out from beneath an upper deck, the back 16 is urged by the back string 26 to rotate to the upright use position, in which the latch 81 engages the flange 80 to secure the back in its use position. As the backs rise, the seats are also permitted to rise to the three-quarters use position shown in FIG. 2 under action of the spring 48. This presents a neat appearance and obviates the need of having a workman manually raise the backs. Further, occupant may stand up to let a person pass and the seat will rise to the three-quarters raised position. The occupant may then step back and further move the seat out of the way to provide further room.

When the rows are retracted for storage, the rearward motion of a lower row relative to an upper row will cause the link assembly 92 to be engaged by the nose 101 of the pusher assembly 90, since the pusher assembly is secured to the next higher row whereas the link assembly is carried by the deck of the row being retracted. This, in turn, will urge the forward link 109 upwardly and rotate the torque tube 94 to release the latches 81 by the upward motion of the fin 96. The latches are completely released prior to the time that the nose of the deck of the next higher row engages the rear of the chair backs to fold them forwardly into the storage position. As the backs move forwardly, they engage the chair seats and lower them into the storage position. It will thus be observed that the locking and unlocking of the chair backs is independent of the order in which a given row is extended or retracted, and it is dependent only on the relative movement between a lower row and the next higher row.

It will thus be apparent that the back is securely locked in the use position when a given row is extended. Further, it is considered advantageous that the chair is an "open" design with no crevices where dirt may collect. Still further, the chairs may be completely assembled to their associated decks at the factory, and need not be installed at the site, as has been the practice with some prior systems employing individual chairs.

Persons skilled in the art will be able to modify certain of the structure which has been illustrated. For example, the chairs could be mounted to the forward portion of a deck or arms could be provided for the chairs. It is, therefore, intended, that all such modifications and substitutions be covered as they are embraced within the spirit and scope of the appended claims.

We claim:

1. In combination with a telescoping seating system including a plurality of rows, each row including a deck, said rows being movable between an extended use position in which the decks are in tiered relation and a retracted storage position in which the decks are in superposed relation, a plurality of chairs each comprising a seat and a back means for pivotally mounting said back to said deck whereby said back may be moved between a raised use position and a lowered storage position; releasable latch means for latching said back when it is in the use position; and actuator means responsive to the retraction of one row relative to an adjacent row for releasing said latch means in said one row, thereby permitting the chair backs in said one row to be moved to the storage position.

2. The apparatus of claim 1 further comprising means for urging said backs to the upright use position when said rows are extended, said latch means engaging said backs in said use position.

3. The apparatus of claim 2 wherein said means for urging said seats to an upright use position comprises a pair of back pivots carried by said deck and supporting said back; and spring means for resiliently biasing said pivots to urge said back to the raised position.

4. The apparatus of claim 1 wherein said actuator means is responsive only to the relative movement of a lower row relative to the next higher row.

5. The apparatus of claim 4 wherein said actuator means comprises a pusher assembly secured to a higher row; and displaceable link means carried by the next lower row for releasing said releasable latch means when engaged by said pusher assembly.

6. The apparatus of claim 5 wherein said link means comprises a first horizontally elongated link, a second vertical link pivotally connected to the forward end of said first link, and a pin on the rear of said first link guided in a cam slot beneath said platform; and wherein said actuator means further comprises a torque tube extending laterally beneath said chairs and coupled to the upper portion of said vertical link.

7. The apparatus of claim 6 wherein said torque tube further comprises a fin extending beneath said chairs and said latch means includes a depending finger, said fin adapted to engage the latch finger of the associated chair when actuated by said pusher means.

8. The apparatus of claim 1 wherein each of said chairs is mounted to the forward portion of an associated deck.

9. In a telescoping seating system including a plurality of rows, each row including a deck, said rows being movable between an extended use position in which the decks are in tiered relation and a retracted storage position in which the decks are in superposed relation, the improvement wherein each row comprises: seat means carried by said deck; back means mounted to said deck for movement between a generally upright use position and a generally horizontal storage position; releasable latch means for latching said back means in the use position; and actuator means for each row, each actuator means being responsive to the retraction of an associated row relative to an adjacent row for releasing said latch means thereof and thereby permitting said back means of said associated row to be pivoted to the storage position.

10. In combination with a telescoping seating system including a plurality of rows, each row including a deck, said rows being movable between an extended use position in which the decks are in tiered relation and a retracted storage position in which the decks are in superposed relation, a plurality of chairs each comprising a seat and a back; means for pivotally said back and said seat to said deck adjacent the forward portion thereof; first means for urging said back to a raised position; second means independent of said means for urging said seat to a three-quarters raised position while permitting said seat to be further raised from said three-quarters raised position for greater passing room, said second means further permitting said seat to be lowered to a horizontal use position; releasable latch means for securing said back in the use position; and actuator means for selectively releasing said latch means.

11. The apparatus of claim 10 further comprising stop means for limiting the downward movement of said seat to the horizontal use position.

12. The apparatus of claim 10 wherein said actuator means comprises a pusher assembly secured to a higher row and a linkage means secured to a lower row; and a torque transmitting element connected to said linkage means and adapted to release said latch means when said linkage means is engaged by said pusher assembly in response to the retraction of said lower row beneath said upper row, thereby to first release said chair back so that the nose of the higher row may urge said chair back and seat into a horizontal position between said rows for storage.

* * * * *

UNITED STATES PATENT OFFICE

CERTIFICATE OF CORRECTION

Patent No. 4,063,392 Dated December 20, 1977

Inventor(s) Arthur Louis Van Ryn, William Rudolph Van Loo and David William Raymond It is certified that error appears in the above-identified patent and that said Letters Patent are hereby corrected as shown below:

Column 8, line 21, after "pivotally" insert -- mounting --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*